United States Patent [19]

Ramachandran et al.

[11] Patent Number: 4,469,605

[45] Date of Patent: Sep. 4, 1984

[54] FABRIC SOFTENING HEAVY DUTY LIQUID DETERGENT AND PROCESS FOR MANUFACTURE THEREOF

[75] Inventors: Pallassana N. Ramachandran, Robbinsville; Paul S. Grand, Highland Park, both of N.J.

[73] Assignee: Colgate-Palmolive Company, New York, N.Y.

[21] Appl. No.: 449,261

[22] Filed: Dec. 13, 1982

[51] Int. Cl.[3] ..... C11D 3/12; D06M 13/24

[52] U.S. Cl. ..... 252/8.7; 252/8.6; 252/174.25; 252/527; 252/532; 252/534; 252/539; 252/551; 252/553; 252/558; 252/DIG. 14

[58] Field of Search ..... 252/8.7, 135, 140, 174.25, 252/532, 534, 539, DIG. 14, 546, 527, 551, 553, 558

[56] References Cited

U.S. PATENT DOCUMENTS

| | | | |
|---|---|---|---|
| 3,962,100 | 6/1976 | Murphy et al. | 252/8.8 |
| 3,966,629 | 6/1976 | Dumbrell | 252/140 |
| 3,993,573 | 11/1976 | Gloss | 252/174.25 X |
| 4,018,720 | 4/1977 | Lengyel et al. | 252/534 |

FOREIGN PATENT DOCUMENTS

| | | |
|---|---|---|
| 8141 | 2/1980 | European Pat. Off. . |
| 72094 | 6/1981 | Japan . |

*Primary Examiner*—Prince E. Willis

*Attorney, Agent, or Firm*—Bernard Lieberman; Herbert S. Sylvester; Murray M. Grill

[57] ABSTRACT

A fabric softening heavy duty liquid detergent, useful for both cleaning and softening laundry, includes certain proportions of sodium linear higher alkylbenzene sulfonate, sodium alkyl polyethoxy sulfate, builder salt (highly preferably a mixture of sodium tripolyphosphate and sodium carbonate), finely divided swelling bentonite and water. Such product is a stable pourable liquid, convenient for use in washing machines, for hand washing of laundry and for pre-treatment of badly soiled portions of items to be laundered. Preferably, the liquid detergent comprises about 9% of sodium linear tridecylbenzene sulfonate, about 2% of sodium alkyl polyethoxy sulfate wherein the alkyl is of 12 to 15 carbon atoms and the polyethoxy is of 3 ethylene oxide groups, 10 to 17% of sodium tripolyphosphate, e.g., 12% and 15%, 2 to 6% of sodium carbonate, e.g., 2% and 6%, about 12% of Wyoming bentonite, and 55 to 65% of water. Also within the invention is a process for manufacturing such liquid detergent wherein the swelling bentonite is admixed with a mixture of the other detergent composition components except for part of the water, which is added last to the mixture of such components and the bentonite.

9 Claims, No Drawings

FABRIC SOFTENING HEAVY DUTY LIQUID DETERGENT AND PROCESS FOR MANUFACTURE THEREOF

This invention relates to a fabric softening heavy duty liquid detergent composition and a method for manufacturing it. More particularly, it relates to such a liquid detergent which comprises described synthetic organic detergent and builder components together with a swelling bentonite in an aqueous medium. The product of the invention is of stable viscosity or thickness, is readily pourable and is a good detergent and fabric softener, which is capable of satisfactorily cleaning and softening laundry washed with it. Also within the invention is a process for manufacture of such liquid detergents.

Heavy duty liquid detergents, useful for machine washing of laundry, have been marketed and have been described in various patents and in the literature. Bentonite has been included in particulate detergent compositions as a fabric softener and has been utilized in aqueous compositions as a thickener, which can help to maintain insoluble particulate materials, such as abrasives, suspended in a liquid medium. However, prior to the present invention it is not considered that bentonite was successfully employed in the manufacture of an acceptable stable fabric softening heavy duty liquid (non-abrasive) detergent in which the bentonite was the fabric softening component. Also, prior to the present invention bentonite was not utilized in an anionic liquid detergent like that described in this application, comprising a particular mixture of anionic synthetic organic detergents and builders and a relatively high proportion of bentonite, considered to be necessary to obtain the desired fabric softening activity.

In accordance with the present invention a fabric softening heavy duty liquid detergent comprises 5 to 15% of sodium linear higher alkylbenzene sulfonate wherein the higher alkyl is of 12 to 13 carbon atoms, 2 to 5% of sodium alkyl polyethoxy sulfate wherein the alkyl is of 10 to 18 carbon atoms and the polyethoxy is of 3 to 11 ethylene oxide groups, 6 to 26% of builder salt selected from the group consisting of sodium tripolyphosphate, sodium carbonate, sodium nitrilotriacetate, and sodium citrate, and mixtures thereof, 10 to 20% of a swelling bentonite, and 40 to 75% of water. The described liquid detergent is a commercially acceptable heavy duty laundry detergent, capable of satisfactorily cleaning laundry items containing both oily and particulate soils and simultaneously depositing on such laundered items sufficient bentonite to appreciably soften them without making them objectionably chalky in appearance. Additionally, the described compositions may be employed for the pre-treatment of badly soiled areas, such as collars and cuffs, of items to be laundered, in which treatment the presence of the bentonite in the liquid, which may be applied directly to the soiled areas, is considered to be useful in mechanically assisting in loosening and/or removing the soil.

The synthetic anionic organic detergent mixture present in the liquid detergents of this invention is a mixture of linear or branched higher alkylbenzene sulfonate and alkyl polyethoxy sulfate. While other water soluble linear higher alkylbenzene sulfonates may also be present in the instant formulas, such as potassium salts and in some instances the ammonium alkanolammonium salts, where appropriate, it has been found that the sodium salt is highly preferred, which is also in the case with respect to the alkyl polyethoxy sulfate detergent component. The alkylbenzene sulfonate is one wherein the higher alkyl is of 12 to 13 carbon atoms, preferably 13 carbon atoms. The alkyl polyethoxy sulfate, which also may be referred to as a sulfated polyethoxylated higher linear alcohol or the sulfated condensation product of a higher fatty alcohol and ethylene oxide or polyethylene glycol, is one wherein the alkyl is of 10 to 18 carbon atoms, preferably 12 to 15 carbon atoms, e.g., about 13 carbon atoms, and which includes 3 to 11 ethylene oxide groups, preferably 3 to 7, more preferably 3 to 5 and most preferably 3 or about 3 ethylene oxide groups. In suitable circumstances other anionic detergents, such as fatty alcohol sulfates, paraffin sulfonates, olefin sulfonates, monoglyceride sulfates, sarcosinates, sulfosuccinates and similarly functioning detergents, preferably as the alkali metal, e.g., sodium, salts, can be present, sometimes in partial replacement of the previously mentioned synthetic organic detergents but usually, if present, in addition to such detergents. Normally, the possibly supplementing detergents will be sulfated or sulfonated products (usually as the sodium salts) and will contain long chain (8 to 20 carbon atoms) linear or fatty alkyl groups. In addition to any supplementing anionic synthetic organic detergents, there also may be present nonionic and amphoteric materials, like the Neodols ®, sold by Shell Chemical Company, which are condensation products of ethylene oxide and higher fatty alcohols, e.g., Neodol ® 23-6.5, which is a condensation product of a higher fatty alcohol of about 12 to 13 carbon atoms with about 6.5 mols of ethylene oxide. Illustrations of the various detergents and classes of detergents mentioned may be found in the text *Surface Active Agents,* Vol. II, by Schwartz, Perry and Berch (Interscience Publishers, 1958), the descriptions of which are incorporated herein by reference.

The builder salt combination of this invention, which has been found to satisfactorily improve detergency of the mixture of synthetic anionic organic detergents, produces the desired pH in the liquid detergent and in the wash water, and coacts with the detergent and the bentonite in the washing and softening process, is a mixture of sodium tripolyphosphate and sodium carbonate. For best processing, easier mixing and good end-use properties it is preferred that the sodium tripolyphosphate be low in content of Phase I type tripolyphosphate. Thus, normally the content of Phase I type tripolyphosphate will be less than 10% of the tripolyphosphate employed. Although in some instances incompletely neutralized tripolyphosphate may be used, normally the phosphate employed may be considered as being pentasodium tripolyphosphate, $Na_5P_3O_{10}$. Of course, in some instances, as when potassium salts of other materials are present, ion interchange in an aqueous medium may result in other salts than the sodium tripolyphosphate being present but for the purpose of this specification it will be considered that sodium tripolyphosphate, as the pentasodium salt, the material which is normally charged to the mixer to make the present liquid detergent, is the tripolyphosphate employed.

Other preferred builder salts which may be used in place of sodium tripolyphosphate and sodium carbonate or in addition thereto include sodium citrate and potassium citrate, and sodium nitrilotriacetate (NTA) and the corresponding potassium salt may be used in partial replacement. Of course, various mixtures of the mentioned water soluble builder salts can be utilized. Yet, the tripolyphosphatecarbonate mixture described has been found to be most preferred, although the other builders and mixtures thereof are also operative, although usually to lesser extents. Other builders may be employed as supplements, in addition to the proportions of the above mentioned builders, subsequently to be described herein. Thus, other phosphates, such as tetrasodium pyrophosphate or tetrapotassium pyrophosphate, sodium bicarbonate, sodium sesquicarbonate, sodium gluconate, borax, sodium silicate, and sodium sesquisilicate, may be employed. Among the water insoluble builders that may be used are the zeolites, such as Zeolite A, usually in the form of its crystalline hydrate, although amorphous zeolites may also be useful. However, it is a feature of this invention that sodium silicate is not needed to make an effective heavy duty detergent-softener composition and therefore such silicate will usually be omitted from the present formulas, and its undesirable properties will therefore also be avoided. For example, any tendency for silicate to react with other components of the liquid detergent, such as a zeolite, sodium carbonate, or other builder, to produce insoluble material which may tend to adhere to the laundry and thereby adversely affect the desirable bright colors of such laundry, will be avoided. Due to the absence of silicate, zeolite may be present in the described liquid detergent without producing undesirable insoluble deposits on the laundry. The absence of silicate in the detergent medium also prevents formation of insoluble siliceous decomposition products of the silicate, which could tend to adversely affect the appearance of the liquid detergent and the laundry if such became apparent in the liquid detergent or deposited on the laundry.

The bentonite employed is a colloidal clay (aluminum silicate) containing montmorillionite. The type of bentonite which is most useful in making the invented base beads is that which is known as sodium bentonite (or Wyoming or Western bentonite), which is normally of a light to cream color or may be a tannish impalpable powder which, in water, can form a colloidal suspension having strongly thixotropic properties. In many instances a potassium bentonite or a mixed sodium-potassium bentonite may be used instead. In water the swelling capacity of such clay will usually be in the range of 3 to 15 or 20 ml./gram, preferably 7 to 15 ml./g., and its viscosity, at 6% concentration in water, will usually be in the range of 3 to 30 centipoises, preferably 8 to 30 centipoises. Preferred swelling bentonites of this type are sold under the trade name Mineral Colloid, as industrial bentonites, by Benton Clay Company, an affiliate of Georgia Kaolin Co. These materials, which are the same as those formerly sold under the trademark THIXO-JEL, are selectively mined and beneficiated bentonites, and those considered to be most useful are available as Mineral Colloid No's. 101, etc., corresponding to THIXO-JEL's No's. 1, 2, 3 and 4. Such materials have pH's (6% concentration in water) in the range of 8 to 9.4, maximum free moisture contents (before addition to the liquid detergent medium) of about 8% and specific gravities of about 2.6. For the pulverized grade of such materials at least about 85% will pass through a 200 mesh U.S. Sieve Series sieve. Preferably all the bentonite will pass through a 200 mesh sieve and most preferably all of it will pass through a No. 325 sieve, so that the equivalent diameter of the bentonite may be considered as being less than 74 microns and more preferably less than 44 microns. Although beneficiated Wyoming bentonite is preferred as a component of the present liquid detergent compositions, other bentonites, including the synthetic bentonites (those made from bentonites having exchangeable calcium and/or magnesium, by sodium carbonate treatment) are also useful and are intended to be included in compositions of this invention. Typical chemical analyses of the bentonites that are useful for making the present liquid detergents show that they contain from 64.8 to 73.0% of $SiO_2$, 14 to 18% of $Al_2O_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Employment of bentonite as the softening agent in the present liquid detergent compositions has the advantage that the bentonite does not have to be dried, as in a spray dryer, and therefore the risk of losing the softening power of the bentonite, due to immobilization of the plates thereof by overdrying, is avoided. Also, it is unnecessary to have the detergent composition of such formula as to promote quick disintegration of the detergent bead in the wash water to release the bentonite particles because in the liquid detergent such particles are not agglomerated into hard masses which could require additional time for disintegration.

The only other required component of the present liquid detergents is water. Normally the hardness content of such water will be less than about 300 p.p.m., as $CaCO_3$, and preferably it will be less than 150 p.p.m. Often it may be desirable to utilize deionized water although often city water with less than 50 or 100 p.p.m. hardness content will be about as satisfactory. While harder waters may be successfully employed in making the present liquid detergents it is considered that soft waters have less likelihood of producing some objectionable materials which could adversely affect the appearance of the liquid detergent or which could deposit objectionably on laundry during washing.

Various adjuvants may be present in the liquid detergents, such as fluorescent brighteners, perfumes and colorants. The fluorescent brighteners include the well known stilbene derivatives, including the cotton and nylon brighteners, such as those sold under the trademark Tinopal (5BM Conc.). The perfumes that are employed usually include essential oils, esters, aldehydes and/or alcohols, all of which are known in the perfumery art. The colorants may include dyes and water dispersible pigments of various types, including ultramarine blue. Because of the lightening effect due to the presence of the bentonite in the liquid detergent, colors of the product may often be attractive pastels. Titanium dioxide may be utilized to lighten the color of the product further or to whiten it. Inorganic filler salts, such as sodium sulfate and sodium chloride may be present, as may be antiredeposition agents, such as sodium carboxymethylcellulose; dispersing agents, such as sodium polyacrylate; enzymes; bleaches; bactericides; fungicides; anti-foam agents, such as silicones; antisoiling agents, such as copolyesters; preservatives, such as formalin; foam stabilizers, such as lauric myristic diethanolamide; and auxiliary solvents, such as ethanol. Normally the individual proportions of such adjuvants will be less than 3%, often less than 1% and sometimes even less than 0.5%, except for any fillers and solvents, and additional detergents and builders for which the proportions may sometimes be as high as 10%. The total proportion of adjuvants, including non-designated synthetic detergents and builders, will normally be no more than 20% of the product and desirably will be less than 10% thereof, more desirably less than 5% thereof. Of course, the adjuvants employed will be noninterfering with the washing and softening actions of the liquid detergent and will not promote instability of the product on standing. Also, they will not cause the production of objectionable deposits on the laundry.

The proportions of the various components in the present liquid detergent will be within the range of 5 to 15%, preferably 7 to 11% and more preferably about 9% of the sodium linear higher alkylbenzene sulfonate; 2 to 5%, preferably 2 to 3% and more preferably about 2% of the sodium alkylpolyethoxy sulfate; 6 to 26%, preferably 12 to 23% and more preferably about 17 to 21% of builder salt; 10 to 20%, preferably 12 to 15% and more preferably about 12% of swelling bentonite; and 40 to 75%, preferably 50 to 70% and more preferably 55 to 65% of water. Of the builder salts, when they are sodium tripolyphosphate and sodium carbonate, the proportions thereof will usually be 5 to 20%, preferably 10 to 17% and more preferably about 11 or 12% of the tripolyphosphate; and 1 to 10%, preferably 2 to 6% of sodium carbonate; with the ratio of tripolyphosphate to carbonate being within the range of 2:1 to 6:1.

The liquid detergents may be made by appropriately mixing the various components thereof, preferably with the bentonite being added near the end of the process. Thus, for example, the anionic detergent may be admixed with the water, after which the polyphosphate and carbonate, in finely divided form, normally sufficiently fine to pass a No. 160 screen, may be added, followed by any adjuvants and the bentonite. However, when the liquid detergent is made by this procedure or by other procedures in which the bentonite is added earlier the mix tends to become excessively thickened. On standing the mix will thin somewhat but this requires additional processing time. It has been found that if a portion of the water is held out and is post-added to the rest of the liquid detergent it will quickly effect a thinning of the detergent to the desired apparent viscosity. The viscosity of the present liquid detergent is normally in the range of about 5 to 100 centipoises, preferably 10 to 70 cp., e.g., 40 cp. It should be kept in mind that the liquid detergent made, largely due to the presence of the bentonite therein, is thixotropic and therefore viscosity figures are to be interpreted accordingly. At the viscosities mentioned the liquid detergent is pourable, stable, non-separating and uniform. Such is somewhat surprising and is attributable to the particular compositions described, the components of which appear to interact to produce the desirably stable, yet freely pourable detergent. Also, the pH of the liquid detergent suspension, usually in the range of 8 to 11.5, preferably 9 to 10.8, appears to help to maintain the product stability and pourability. Aqueous bentonite suspensions in water at the concentrations utilized in the present liquid detergent can sometimes produce thick gels which are not pourable and it appears that the mixture of linear alkylbenzene sulfonate, ethoxylated alcohol sulfate and the described builders helps to keep the bentonite in the aqueous medium from gelling excessively.

Experience has shown that the desirable proportion of water to hold back and admix last in the manufacturing process is normally 5 to 20% of the final liquid detergent, preferably 8 to 12%, e.g., about 10% thereof. During the mixing of the various components with the aqueous medium, and especially when the bentonite is added and the remaining water is admixed, it is important to maintain the mixture in motion, as by continuing to mix or stir it. Preferably, the mixer is never turned off and the process is continuous, normally taking about 3 to 30 minutes, preferably 5 to 10 minutes per batch. While the water may be warmed to promote dissolving of the various product components therein and to promote dispersing of the bentonite, such is not necessary and room temperature water, e.g., water at a temperature in the range of 15° to 30° C., such as 20° to 25° C., may be used.

The following examples illustrate but do not limit the invention. Unless otherwise indicated all parts are by weight and all temperatures are in °C.

EXAMPLE 1

| Components | Percent |
|---|---|
| Sodium linear tridecylbenzene sulfonate | 9.0 |
| Sodium alkyl polyethoxy sulfate (alkyl = fatty alkyl of 12 to 15 carbon atoms; polyethoxy = 3 ethoxy groups) | 2.2 |
| Pentasodium tripolyphosphate (10% or less of Phase 1) | 11.0 |
| Sodium Carbonate (anhydrous) | 4.0 |
| Bentonite (Mineral Colloid 101) | 12.0 |
| Fluorescent brightener (Tinopal 5BM Conc.) | 0.3 |
| Perfume | 0.3 |
| Colorant (ultramarine blue or FD & C dye solution) | 0.2 |
| Water (city water of about 50 p.p.m. of hardness as calcium carbonate) | 61.0 |
| | 100.0 |

51 Parts of water are added to a suitable mixer, such as a vertical cylindrical tank equipped with heating and cooling means and connected to a discharge pump, the synthetic organic detergents are added, with stirring (by a Lightnin type mixer), and the polyphosphate and carbonate builder salts (of particle sizes that pass a No. 160 sieve) are admixed, with the phosphate being added first, after which the fluorescent brightener and colorant are admixed. Mixing of the batch, which weighs about 500 kilograms, takes about four minutes. Then, the swelling bentonite is admixed with the mixture, which results in the mix viscosity being raised higher than desired. The balance of the water is added and the perfume is then admixed and the product is ready to be pumped out of the mixer and into end use containers. During the mixing operation, all of which takes about nine minutes, the materials added and the final product are at a temperature of about 20° C. In some cases, to promote faster dissolving and quicker dispersing of the components, the temperature of the water charged may be raised to 40° to 50° C. so that the final product temperature may be about 30° to 40° C., in which case the mixing time may be reduced to about 5 or 6 minutes.

The liquid detergent resulting (at room temperature) has a viscosity of about 50 cp. and pours satisfactorily from a plastic detergent bottle with a discharge opening of about 2.5 cm. It has a pH of about 10.6. The liquid detergent is employed to wash a mixed load of soiled laundry, some of which includes cotton swatches and polyester/cotton swatches soiled with particulate soil and with sebum soil. The liquid detergent is added to the tub of a standard washing machine with about one-half cup of the liquid detergent being employed per wash (to make the concentration of liquid detergent in wash water about 0.19%). The temperature of the wash water is 21° C. (to test the "cold" water washing capabilities of the product) and the water is of a mixed calcium and magnesium hardness of about 150 p.p.m., as $CaCO_3$. After washing of the laundered items and the test swatches they are either "line dried" or machine dried (in a conventional laundry dryer).

The same operations as described above are repeated for a control detergent formulation wherein the bentonite is omitted, being replaced by water.

Softness ratings of the various laundered items and swatches, assigned by a panel of observers, establish that the liquid detergent incorporating bentonite made the laundry and swatches significantly softer than the control detergent and yet the presence of the bentonite particles did not substantially adversely affect the cleaning power of the product, although the cleaning of polyester/cotton swatches stained with clay soil was somewhat poorer for the experimental formula.

The experimental liquid detergent is of an attractive light blue uniform appearance and on storage does not settle into different layers of materials. After storage it is still readily pourable but if for any reason it should become too thick it can be made pourable by shaking, or flexing of the plastic (polyethylene or polypropylene) container. Still, shaking is not necessary to make sure that the composition is uniform.

In addition to being useful as a detergent for machine washing the product of the present invention may be employed in hand washing of laundry and as a liquid for pre-treatment of excessively soiled areas of laundry. In hand washing of laundry, to promote maximum deposition of bentonite on the laundry and thereby to improve the softening effects thereof the washing solution is allowed to drain out of the washtub through a bottom drain so that it passes through the laundry, after which the laundry may be rinsed in normal manner. When employed as a pre-treatment for soiled areas of laundry the liquid detergent is applied full strength (although dilutions may also be used) to the soiled areas and is rubbed into them. During such application and rubbing the bentonite assists the detergent in loosening and removing the soil, whether it be oily or particulate soil, and at the same time some of the bentonite adheres to the fibers of the material of the laundry, thus helping to soften laundry material at such location. Such softening may contribute to lesser soiling of the area in the future, especially when the soiled areas are shirt cuffs or collars.

EXAMPLE 2

A liquid detergent like that of Example 1 is formulated using a linear dodecylbenzene sulfonate in place of the linear tridecylbenzene sulfonate, sodium alkyl polyethoxy sulfate wherein the alkyl is of 12 to 13 carbon atoms and the polyethoxy is of an average of 6.5 ethoxy groups, instead of that previously employed, 11% of the STPP, 6% of sodium carbonate, 15% of bentonite, the adjuvants previously mentioned and 56% of water. The additional sodium carbonate improves the miscibility of the various components during the manufacturing procedure and the replacement of the detergents does not significantly adversely affect the properties of the product. The product is made in essentially the same manner as previously described.

The liquid detergent is a stable pourable liquid having the desirable cleaning and softening properties described for the liquid detergent of Example 1, whether used for machine washing or hand washing of laundry, or for pre-treatments thereof.

Similarly, acceptable liquid detergents are made when 3% of sodium lauryl alcohol sulfate, 2% of Neodol 23-6.5 and 0.5% of silicone anti-foam oil are incorporated in the product by addition to the components of Example 1 (replacing water). Also when sodium citrate or potassium citrate is employed to replace the sodium carbonate (or when only partial replacements of such materials, e.g., 30% replacements, are effected with such citrates or trisodium nitrilotriacetate) useful liquid detergents result, having properties like those of the compositions previously described.

EXAMPLE 3

A liquid detergent like that of Example 1 is made but only 2% of sodium carbonate is employed in the formulation, with the water content being increased correspondingly. Although the sodium carbonate content is decreased the mix is still processable to a final product of desirable properties, which is useful as a heavy duty laundry detergent for washing cotton and synthetic materials and softening them, and is also useful as a pre-treatment for such laundry. When 0.5% of sodium carboxymethylcellulose is added to the formula in place of part of the water thereof improved whitening of the laundry is obtained without substantial loss of softening power due to the anti-redeposition activity of the CMC.

In other variations of the invention, when the proportions of the various components of the liquid detergent of Example 1 are changed ±10% or ±20%, without going outside the ranges given in this specification, stable, pourable liquid detergents of useful cleaning and softening effects result. In some such products it may be desirable to include as much as 10% of Zeolite A or up to 5% of sodium silicate of $Na_2O:SiO_2$ ratio of about 1:2.4, although the silicate will often be avoided, and if the zeolite is present, to avoid depositing of zeolite-silicate aggregates or reaction products the silicate will normally be omitted. If thinning of the liquid is desired up to 10% of ethanol or isopropanol may be employed.

As is seen from the preceding description and the working examples, the fabric softening heavy duty liquid detergents of this invention are stable, uniform, attractive and functional. Despite the presence of a substantial proportion of gelling agent (bentonite) in a liquid medium, they do not form objectionable gels and they remain pourable during storage. Also, despite lengthy storage, during which the suspended bentonite is subjected to intimate contact with surface active agents and inorganic salt builders in an aqueous medium the bentonite does not objectionably agglomerate and its softening action on laundry is not destroyed. By using the mentioned detergents and builders in an aqueous medium there is produced a liquid detergent which, despite the content of a substantial proportion of bentonite of the swelling type, remains liquid and pourable and retains its physical and chemical characteristics which allow it to be deposited on the laundry and act as a lubricant for the fibers thereof, thereby promoting softening of such laundry. Also, as was previously mentioned, by employment of the liquid medium the possibility that the bentonite would be deactivated by overheating, as in a spray drying tower, is obviated.

The present liquid detergents, in addition to being useful as products for machine and hand washing of laundry, are also good for pre-treatments of stained portions of laundry, in which treatments it is considered that the bentonite content assists in removing the stains and in softening the stained area (and the product is also subsequently employed for washing purposes). Thus, from the foregoing recitation of the properties and advantages of the present invention it is seen that it represents a significant advance in the detergent composition art because it allows convenient employment of a liquid detergent to both clean and soften laundry (and to pretreat it) while utilizing excellent anionic synthetic organic detergents and not having to incorporate with them adversely chemically reactive cationic materials, such as quaternary ammonium salts. Furthermore, the bentonites employed are not ecologically harmful, as the quaternary ammonium salts might be, and do not cause buildups of objectionable fatty deposits on laundry, which often can cause it look discolored, as the quaternaries sometimes do.

While the sodium salts and sodium compounds of the various components of the present liquid detergents have been described because they are especially satisfactory and are commercially available, the corresponding potassium compounds may be substituted for them, at least in part, and are also within this invention. Thus, potassium detergents, potassium builder salts, potassium bentonites and potassium adjuvant salts can be used and such are intended to be included with sodium compounds as "alkali metal" compounds.

The invention has been described with respect to various embodiments and working examples but is not to be limited to these because it is evident that one of skill in the art, with the present specification before him, will be able to utilize substitutes and equivalents without departing from the invention.

What is claimed is:

1. A fabric softening heavy duty liquid detergent comprising 5 to 15% of alkali metal linear or branched higher alkylbenzene sulfonate wherein the higher alkyl is of 12 to 13 carbon atoms, 2 to 5% of alkali metal alkyl polyethoxy sulfate wherein the alkyl is of 10 to 18 carbon atoms and the polyethoxy is of 3 to 11 ethylene oxide groups, 6 to 26% of builder salt selected from the group consisting of alkali metal tripolyphosphate, alkali metal carbonate, alkali metal nitrilotriacetate, and alkali metal citrate, and mixtures thereof, 12 to 15% of a swelling bentonite, and 40 to 75% of water.

2. A liquid detergent according to claim 1 wherein the alkali metal is sodium.

3. A liquid detergent according to claim 2 wherein the sodium linear higher alkyl benzene sulfonate is sodium linear or branched tridecylbenzene sulfonate, the sodium alkyl polyethoxy sulfate is one wherein the alkyl is of 12 to 15 carbon atoms and the polyethoxy is of 3 to 7 ethylene oxide groups, the builder salt is a mixture of sodium tripolyphosphate and sodium carbonate in a proportion within the range of 2:1 to 6:1 and the swelling bentonite is a sodium bentonite.

4. A liquid detergent according to claim 3 comprising 7 to 11% of sodium linear tridecylbenzene sulfonate, 2 to 3% of sodium alkyl polyethoxy sulfate wherein the alkyl is of 12 to 15 carbon atoms and the polyethoxy is of about 3 ethylene oxide groups, 5 to 20% of sodium tripolyphosphate containing less than 10% thereof of Phase I type tripolyphosphate, 1 to 10% of sodium carbonate, 12 to 15% of sodium bentonite of particle sizes less than 44 microns, and 50 to 70% of water.

5. A liquid detergent according to claim 4 comprising about 9% of sodium linear tridecylbenzene sulfonate, about 2% of sodium alkyl polyethoxy sulfate wherein the alkyl is of 12 to 15 carbon atoms and the polyethoxy is of 3 ethylene oxide groups, 10 to 17% of sodium tripolyphosphate, 2 to 6% of sodium carbonate, about 12% of Wyoming bentonite and 55 to 65% of water.

6. A liquid detergent according to claim 5 comprising from 0.1 to 2% of fluorescent brightener, 0.05 to 1% of perfume and 0.01 to 1% of colorant.

7. A process for manufacturing a fabric softening heavy duty liquid detergent comprising 5 to 15% of alkali metal linear higher alkylbenzene sulfonate wherein the alkyl is of 12 to 13 carbon atoms, 2 to 5% of alkali metal alkyl polyethoxy sulfate wherein the alkyl is of 10 to 18 carbon atoms and the polyethoxy is of 3 to 11 ethylene oxide groups, 6 to 26% of builder salt selected from the group consisting of alkali metal tripolyphosphate, alkali metal carbonate, alkali metal nitrilotriacetate, and alkali metal citrate, and mixtures thereof, 10 to 20% of a swelling bentonite and 40 to 75% of water, which comprises mixing together the mentioned components with the exception of the swelling bentonite and 5 to 20%, on a final product basis, of the water, admixing the swelling bentonite to such mixture while it is being stirred, and subsequently admixing the remaining 5 to 20% of water with the resulting mixture, while it is being stirred.

8. A process according to claim 7 wherein the alkali metal is sodium.

9. A process according to claim 8 wherein the liquid detergent manufactured comprises about 9% of sodium linear tridecylbenzene sulfonate, about 2% of sodium alkyl polyethoxy sulfate wherein the alkyl is of 12 to 15 carbon atoms and the polyethoxy is of 3 ethylene oxide groups, 10 to 17% of sodium tripolyphosphate, 2 to 6% of sodium carbonate, with the ratio of sodium tripolyphosphate to sodium carbonate being in the range of 2:1 to 6:1, about 12% of Wyoming bentonite, and 55 to 65% of water, the components initially mixed together are those mentioned with the exception of the swelling bentonite and about 10%, on a final product basis, of the water, the swelling bentonite is admixed with such mixture while it is being stirred, and the remaining water is subsequently admixed with the resulting mixture while it is being stirred.

* * * * *

UNITED STATES PATENT AND TRADEMARK OFFICE

CERTIFICATE OF CORRECTION

PATENT NO. : 4,469,605

DATED : September 4, 1984

INVENTOR(S) : Pallassana N. Ramachandran and Paul S. Grand

It is certified that error appears in the above-identified patent and that said Letters Patent are hereby corrected as shown below:

Col. 1, line 12, delete "is of stable viscosity or thickness,"; line 28, delete "stable";

Col. 2, line 67, replace "salt" with --- salts ---;

Col. 3, line 37, replace "montmorillionite" with --- montmorillonite ---;

Col. 4, line 54, after "chloride" insert --- , ---;
line 65, after "builders" insert --- , ---;

Col. 5, lines 42-49, delete and replace with --- ity. The liquid detergent made, largely due to the presence of bentonite therein, is thixotropic. The liquid detergent is pourable, non-separating and uniform. Such is ---;

Col. 6, line 58, delete "has a viscosity of about 50 cp. and"; Col. 8, lines 47,48, delete "and they remain pourable during storage ---; and
lines 57,58, delete "remains liquid and pourable and".

Signed and Sealed this

Fourth Day of June 1985

[SEAL]

Attest:

DONALD J. QUIGG

Attesting Officer

Acting Commissioner of Patents and Trademarks